US007708090B2

(12) United States Patent
Zahradnik et al.

(10) Patent No.: US 7,708,090 B2
(45) Date of Patent: May 4, 2010

(54) EXCLUDER RING FOR EARTH-BORING BIT

(75) Inventors: Anton Zahradnik, Sugarland, TX (US); Gregory L. Ricks, Spring, TX (US); Gregory W. Peterson, Fort Worth, TX (US); Don Quy Nguyen, Houston, TX (US); Chih C. Lin, Spring, TX (US); Terry J. Koltermann, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 241 days.

(21) Appl. No.: 11/485,406

(22) Filed: Jul. 12, 2006

(65) Prior Publication Data

US 2008/0011518 A1 Jan. 17, 2008

(51) Int. Cl.
*E21B 10/25* (2006.01)

(52) U.S. Cl. ..... 175/371; 175/227; 277/548

(58) Field of Classification Search ..... 175/371, 175/372, 227, 337; 277/338, 500, 548
See application file for complete search history.

(56) References Cited

U.S. PATENT DOCUMENTS 3,862,762 A 1/1975 Millsap
4,249,781 A * 2/1981 Olschewski et al. ..... 384/94
4,466,621 A * 8/1984 Garner et al. ..... 277/362
4,619,534 A * 10/1986 Daly et al. ..... 384/94
4,762,189 A * 8/1988 Tatum ..... 175/371
RE36,452 E * 12/1999 Upton et al. ..... 277/336
6,033,117 A 3/2000 Cariveau et al.
6,196,339 B1 3/2001 Portwood et al.
6,254,275 B1 7/2001 Slaughter, Jr. et al.
6,264,367 B1 7/2001 Slaughter, Jr. et al.
6,305,483 B1 10/2001 Portwood
6,336,512 B1 1/2002 Siracki et al.
6,431,293 B1 8/2002 Portwood et al.
6,533,051 B1 3/2003 Singh et al.
6,536,542 B1 3/2003 Fang et al.
2002/0153172 A1 10/2002 Portwood et al.
2003/0019666 A1 1/2003 Portwood et al.
2003/0029645 A1 2/2003 Mourik et al.
2004/0031624 A1 2/2004 Scott et al.
2005/0274550 A1* 12/2005 Yu et al. ..... 175/372
2008/0073124 A1* 3/2008 Lin ..... 175/371

* cited by examiner

*Primary Examiner*—David J Bagnell
*Assistant Examiner*—David Andrews
(74) *Attorney, Agent, or Firm*—Bracewell & Giuliani LLP

(57) ABSTRACT

An elastomeric seal ring is located between each bearing pin and each cone of an earth-boring bit. An excluder ring or band is imbedded within the inner diameter of the seal ring. A portion of the inner diameter of the seal ring as well as the excluder ring are in dynamic sealing contact with the bearing pin. The excluder ring may be harder and more wear resistant than the seal ring. The excluder ring may have lubricating properties. An outer excluder ring may be located on the outer diameter of the seal ring for engaging the cone to resist rotation.

7 Claims, 4 Drawing Sheets

Fig. 3
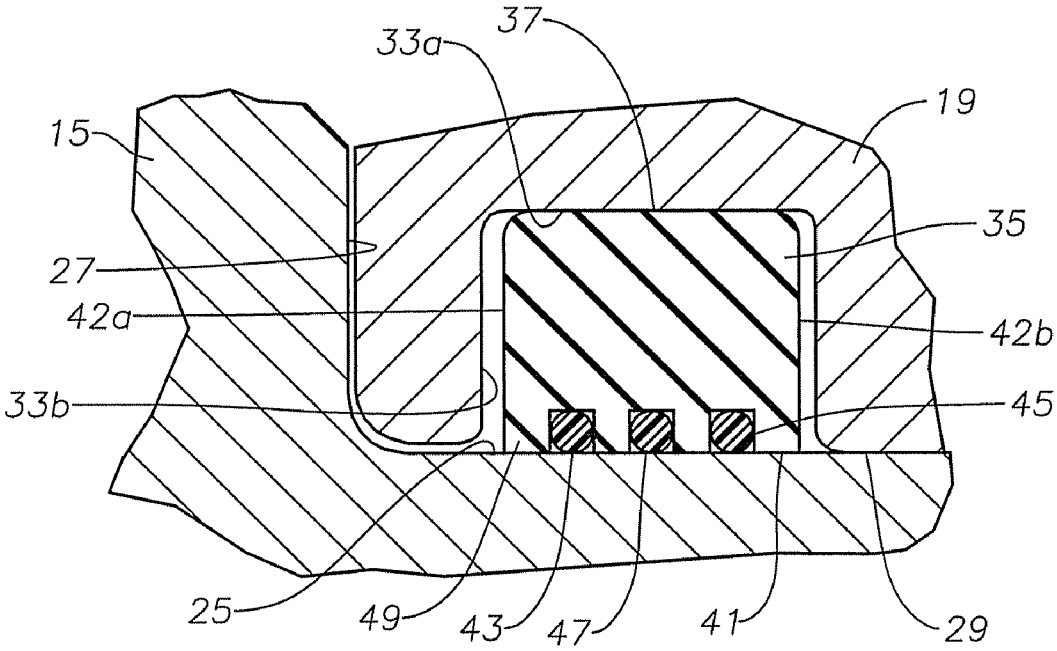
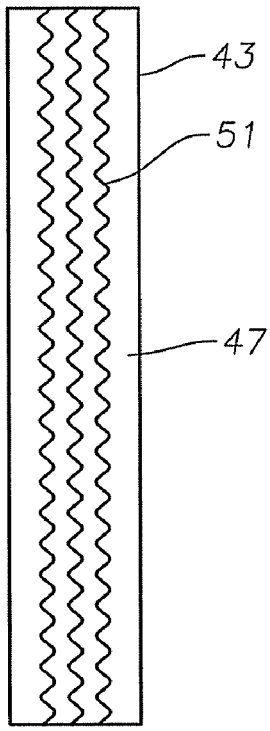
Fig. 4
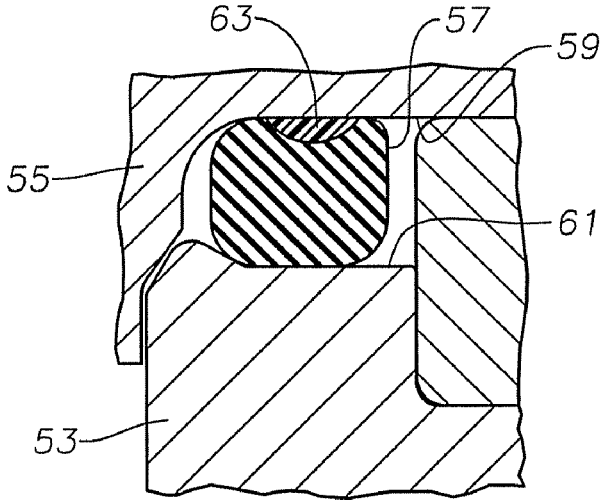
Fig. 5

EXCLUDER RING FOR EARTH-BORING BIT

BACKGROUND OF THE INVENTION

One type of earth-boring bit has a body with at least one rotatable cone mounted to a depending bearing pin. Typically there are three cones, each having rows of cutting elements. The cutting elements may be machined from the metal of the cone, or they may comprise tungsten carbide inserts pressed into holes in the exterior of the cone.

The cone has a cavity that inserts over the bearing pin, forming a journal bearing. The clearances between the bearing surfaces are filled with a grease or lubricant. A seal assembly seals between the bearing pin and the cone near the mouth of the cone.

The seal assembly serves to prevent loss of lubricant to the exterior. Also, the seal assembly serves to exclude debris and cuttings of the borehole from entering the journal bearing. Typically the outer diameter of the seal assembly rotates with the cone and the inner diameter seals against the bearing pin in dynamic contact.

Many different seal assemblies have been proposed and used in the prior art. A variety of shapes of elastomeric seals have been employed. Elastomeric seals that have different materials on the inner and outer diameters are known. Elastomeric seals with carbon fiber fabric on the dynamic portions of the seal are also known. In addition, metal face seal assemblies including an elastomer that urges the metal faces together are also known.

SUMMARY OF THE INVENTION

The seal assembly of this invention comprises a seal ring of an elastomeric material. The seal ring has an inner portion that seals against a sealing surface on the bearing pin and an outer portion that seals against a sealing surface in the cone. At least one excluder ring is mounted in one of the portions of the seal ring and has a face urged by the seal ring into contact with one of the sealing surfaces.

Preferably the seal ring has more than one excluder ring. One excluder ring may be more abrasion resistant than the seal ring to protect the seal ring from damage due to cuttings in the drilling fluid. Another of the excluder rings may be formed of a self-lubricating material for providing lubrication to the seal ring. An excluder ring may be located on the outer diameter of the seal rings, also, for frictionally engaging the cone to resist rotation of the seal ring relative to the cone.

BRIEF DESCRIPTION OF THE DRAWINGS

FIG. 3 is a further enlarged sectional view of a portion of the seal ring and excluder rings of FIG. 2.

FIG. 4 is a schematic sectional view of an inner diameter portion of one of the excluder rings imbedded within the seal ring of FIG. 2, illustrating a grooved pattern.

FIG. 5 is a partial sectional view of another embodiment of a seal ring and excluder ring.

DETAILED DESCRIPTION OF THE INVENTION

Figure 1:
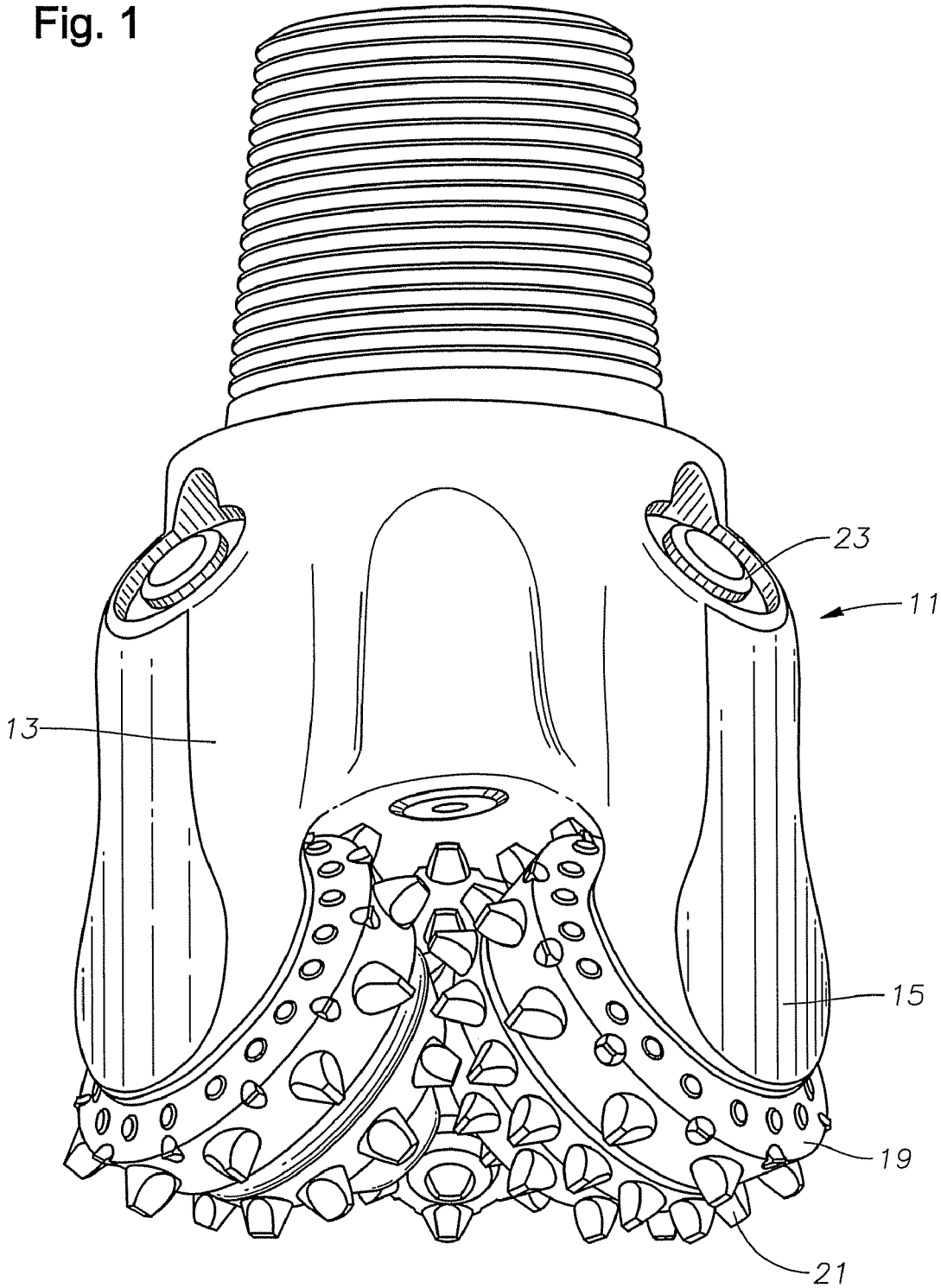
FIG. 1 is a side elevational view of an earth-boring bit constructed in accordance with this invention.

Referring to FIG. 1, bit 11 has a body 13 with a threaded upper end for connection to a drill string for rotation about an axis of body 13. Body 13 has at least one and preferably three bit legs 15. A bearing pin 17 (FIG. 2) depends downward and inward from each bit leg 15.

A cone 19 mounts rotatably to each bearing pin 17. Each cone 19 has a plurality of rows of cutting elements 21. In the example shown, cutting elements 21 comprise tungsten carbide inserts pressed into mating holes drilled in the metal of each cone 19. Alternatively, cutting elements 21 could comprise teeth machined into the metal of each cone 19.

A lubricant compensator 23 supplies lubricant to bearing spaces between the interior of each cone 19 and bearing pin 17. Lubricant compensator 23 also equalizes the pressure of the lubricant with the exterior pressure in the borehole.

Figure 2:
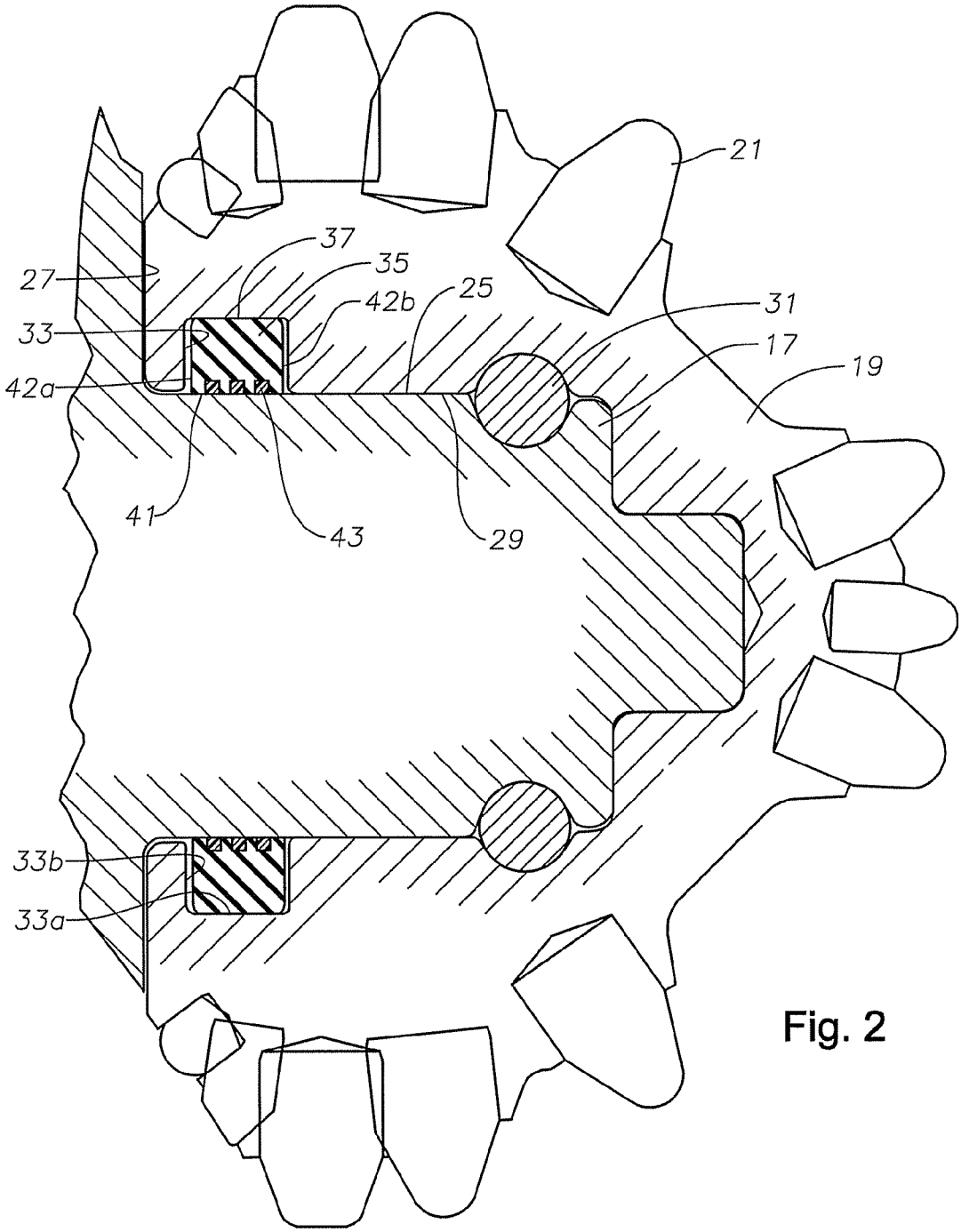
FIG. 2 is an enlarged sectional view of one of the cones and bearing pins of the earth-boring bit of FIG. 1, illustrating a seal ring having imbedded excluder rings in accordance with the invention.

Referring to FIG. 2, bearing pin 17 has a cylindrical journal surface 25 that serves as a bearing for the weight imposed on drill bit 11 (FIG. 1). A last machined surface 27 encircles bearing pin 17 on the inside of each bit leg 15. Cone 19 has a cavity 29 with interior surfaces that mate with the exterior surfaces of bearing pin 17. Cone 19 and bearing pin 17 have means for locking cone 19 on bearing pin 17. In this embodiment, the locking means comprises a plurality of balls 31 located within mating grooves formed on bearing pin 17 and in cone cavity 29.

A seal groove 33 is formed in cavity 29 near its mouth. In this embodiment, groove 33 is rectangular when viewed in cross-section. Groove 33 has a flat base or outer diameter 33*a*, when viewed in transverse cross-section, and two flat sidewalls 33*b*.

A seal ring 35 is carried within groove 33 for sealing lubricant against leakage to the exterior. Seal ring 35 is formed of an elastomeric material of a type that is conventional for elastomeric seals for earth-boring bits. Preferably this material comprises a nitrile rubber such as hydrogenated nitrile butadiene rubber, but it could be other types of material as well. Seal ring 35 has an outer portion or diameter 37 that seals against groove 33. Seal ring 35 has an inner diameter or portion 41 that may have a cylindrical portion, thus appears flat when viewed in the transverse cross-section of FIG. 2. Inner diameter 41 seals and normally rotatably slides against bearing pin journal surface 25. Seal ring 35 has an exterior side 42*a* and an interior side 42*b*, which are shown in parallel planes, but could be other shapes. Side 42*a* is on the exterior side of seal ring 35 and is exposed to drilling fluid during operation through the clearance between last machined surface 27 and the backface of cone 19. Side 42*b* is on the interior side of seal ring 35 and is in contact with lubricant contained in the bearing spaces. Sidewalls 42*a*, 42*b* are spaced slightly from groove sidewalls 33*b* so as to accommodate deformation.

At least one thermoplastic excluder band or ring 43 is located within seal ring 35. Three excluder rings 43 are shown in this embodiment, but the number could be less or more. Referring to FIG. 3, in this embodiment, each excluder ring 43 is located within an annular recess 45 formed in seal ring inner diameter 41. Excluder rings 43 may be bonded within annular recesses 45 or held by friction. Each excluder ring 43 has a contacting face 47 on its inner diameter that is substantially flush with seal ring inner diameter 41 and which is urged by seal ring 35 into dynamic contact with bearing pin journal surface 25.

In this example, excluder rings 43 are spaced apart from each other along the axis of bearing pin 17. The spacing results in annular sections 49 of seal ring 35 located on each lateral side of each excluder ring 43, each section 49 sealing against bearing pin journal surface 25. One of the sections 49 is located between exterior side 42*a* and its closest excluder ring 43 and another between interior side 42*b* and its closest excluder ring 43. Also, a section 49 exists between each of the excluder rings 43. The width of seal ring 35 from interior side 42*b* to exterior side 42*a* is greater than the total combined width of the contacting face 47 of each excluder ring 43.

In FIG. 2, excluder rings 43 are shown with a rectangular configuration when viewed in transverse cross-section, each having a cylindrical contact face 47 and a cylindrical outer diameter. However, other cross-sectional configurations are feasible. In FIG. 3, excluder rings 43 are shown with a circular configuration.

Excluder rings 43 also slidingly and sealingly engage journal surface 25, but typically do not seal as well as seal ring 35 because they serve other purposes. For example, one or more of excluder rings 43 may be formed of a harder and more wear resistant material to trap or exclude debris. One or more of excluder rings 43 may be formed of a known self-lubricating material for providing lubrication. In the preferred embodiment, excluder rings 43 are formed of one of the following materials: polyether ether ketone, polytetrafluoroethylene, polyphenylenesulfide and fiber reinforced composite thereof. However, other materials are also feasible. The material should be resistant to relative high temperatures and resistant to abrasion due to cuttings and other erosive particles in the drilling fluid. One preferred material for providing more resistance is polyether ether ketone with reinforcing fibers, either glass or carbon. If used to trap and exclude debris, the wear rate of each excluder ring 43 is preferably less than seal ring 35. The hardness of each excluder ring 43 used to trap and exclude debris is greater. If one of the excluder rings 43 is used primarily for lubrication, its hardness may be less than that of seal ring 35. A referred material for providing self-lubrication of an excluder ring 43 is polytetrafluoroethylene. An excluder ring 43 for providing lubrication would contain polytetrafluoroethylene and have less wear resistance than seal ring 35.

Micro texturing may be formed in the inner diameters 47 of each excluder ring 43 to enhance sealing. Micro texturing comprises very shallow recesses formed in the surface by known techniques, such as by laser. A wide variety of texturing is feasible. As an example, FIG. 4 shows generally sinusoidal grooves 51 extending in three rows around the inner diameter 47. Grooves 51 enhance sealing even if the lubricant flow due to rotation of excluder rings 43 is bi-directional.

In operation, as bit 11 rotates, each cone 19 will rotate about its bearing pin 17 (FIG. 2). Each seal ring 35 will tend to rotate with its cone 19 and sealingly engage journal surface 25 of bearing pin 17 in dynamic sliding contact. Excluder rings 43 also engage journal surface 25 in dynamic contact. As seal ring 35 wears due to abrasive drilling fluid, excluder rings 43 will eventually be contacted by the drilling fluid. Those that are harder and more resistant to abrasion than seal ring 35 will retard the wear rate of seal ring 35. Generally, the wear would be from the exterior side 42*a* toward the interior side 42*b*. As one seal ring section 49 wears away, the next inward excluder ring 43 will be contacted by the abrasive drilling fluid, delaying the contact of the abrasive drilling fluid with the sealing sections 49.

In FIG. 5, a cone 53 is mounted on a roller bearing pin 55 with rollers, generally as in the first embodiment. Seal ring 57 has an inner portion that seals in rotating dynamic contact with bearing pin journal surface 59 and an outer portion that seals against cone cavity 61. In this embodiment, a single excluder ring 63 is mounted in a groove on the inner portion of seal ring 57. Excluder ring 63 has a generally flat face that contacts journal surface 59. The remaining cross-sectional shape of excluder ring 63 is curved and convex. Portions of the inner portion of seal ring 57 on the interior and exterior sides of excluder ring 63 sealingly engage journal surface 59. Excluder ring 63 is formed of a material as described above that is harder than seal ring 57 for excluding debris and retarding wear on seal ring 57.

Figure 6:
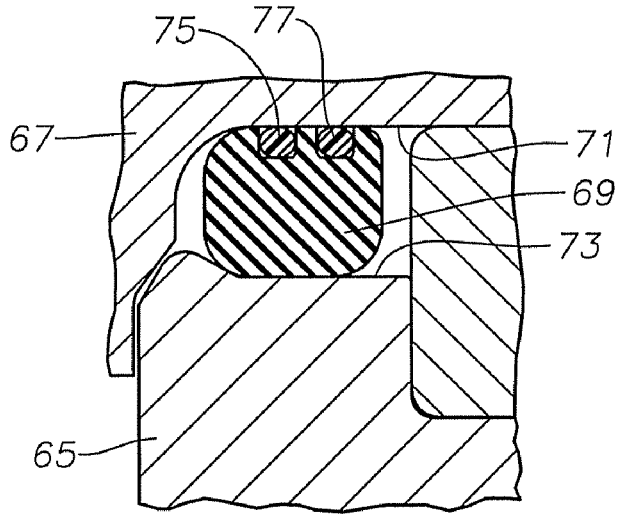
FIG. 6 is a partial sectional view of another embodiment of a seal ring and excluder ring.

In FIG. 6, a cone 65 is mounted on a bearing pin 67 generally as in the first embodiment. Seal ring 69 has an inner portion that seals in rotating dynamic contact with bearing pin journal surface 71 and an outer portion that seals against cone cavity 73. In this example, there are two excluder rings 75, 77, and each has a contacting face with a different configuration. Excluder ring 75 is located on the exterior side of excluder ring 77 and is shown to have a triangular face with an apex that dynamically contacts journal bearing surface 71. Excluder ring 77 has a convex or rounded cross-sectional shape, including its contacting face. Excluder ring 75 is preferably formed of a harder and more wear resistant material than seal ring 69. Excluder ring 77 may be formed of a material that provides lubrication and may be softer and less wear resistant than excluder ring 75 and seal ring 69.

Figure 7:
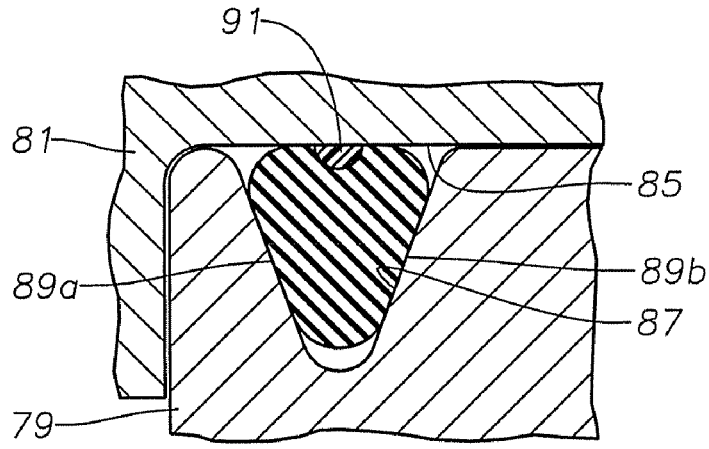
FIG. 7 is a partial sectional view of another embodiment of a seal ring and excluder ring

In FIG. 7, a cone 79 is mounted on a bearing pin 81 generally as in the first embodiment. Seal ring 83 has an inner portion that seals in rotating dynamic contact with bearing pin journal surface 85 and an outer portion that seals against a groove 87 in cone 79. Groove 87 is triangular shaped in this example. Seal ring 83 has a flat exterior side 89*a* and a flat interior side 89*b* that wedge against the sides of groove 87. A single excluder ring 91 in shown on the inner portion of seal ring 83 in engagement with journal bearing surface 85, but more than one is feasible. Excluder ring 91 may be of various shapes and is shown to have a shape generally like that of excluder ring 63 in FIG. 5. Excluder ring 91 is preferably formed of the same material as excluder ring 63 and serves the same purpose.

Figure 8:
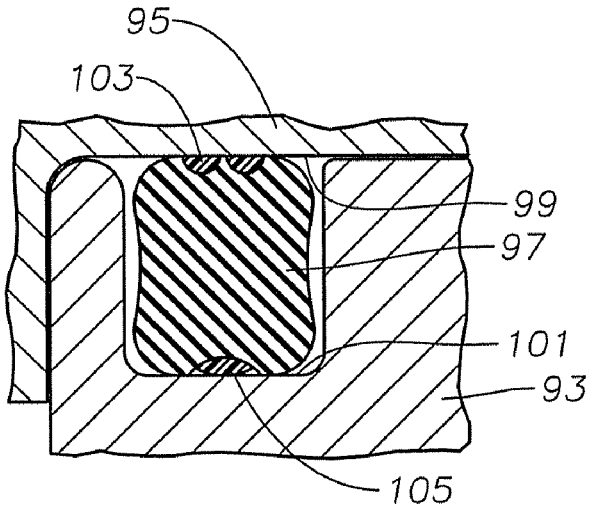
FIG. 8 is a partial sectional view of another embodiment of a seal ring and excluder ring.

In FIG. 8, a cone 93 is mounted on a bearing pin 95 generally as in the first embodiment. Seal ring 97 has an inner portion that seals in rotating dynamic contact with bearing pin journal surface 99 and an outer portion that seals against a groove 101 in cone 93. Two excluder rings 103 are shown on the inner diameter of seal ring 97. Excluder rings 103 are shown with shapes similar to that of excluder ring 63 in FIG. 5. At least one of excluder rings 103 is of a material harder than seal ring 97 for excluding debris. The other excluder ring 103, if desired, may be of a lubricating material.

An outer excluder ring 105 is shown embedded within a groove on the outer diameter of seal ring 97 and in frictional engagement with the base of cone groove 101. Outer excluder ring 105 serves to frictionally grip cone 93 to resist slippage and rotation of seal ring 97 relative to cone 93. Outer excluder ring 105 may be formed of a material that has good gripping properties, the hardness of which may be less than seal ring 97. Outer excluder ring 105 may have a variety of shapes, but is shown as having a shape similar to excluder ring 63 of FIG. 5. Although not expected, it is possible that one prefers to cause seal ring 97 to remain stationary on bearing pin 95 while cone 93 rotates. If so, excluder ring 105, having good gripping properties, would be located on the inner diameter of seal ring 97 and one or more excluder rings 103 for retarding wear and/or enhancing lubrication would be located on the outer diameter of seal ring 97.

The term "excluder" has been used in connection with the rings, whether designed to exclude and trap debris, or to lubricate, or to resist rotation. This term is used only for convenience and not in a limiting manner.

The invention has significant advantages. The inclusion of more wear resistant excluder rings into a seal ring reduces the rate of wear on the seal ring. The reduction in wear rate increases the life of the drill bit by retaining lubricant in the journal bearing. Excluder rings with lubricating properties may be used to add lubrication, which reduces heat and prolongs the life of the seal ring. Excluder rings with gripping properties may be used to resist rotation of the seal ring.

While the invention has been shown in only a few of its forms, it should be apparent to those skilled in the art that it is not so limited but is susceptible to various changes without departing from the scope of the invention.

The invention claimed is:

1. An earth boring bit having a body with a depending bearing pin, and a cone rotatably mounted to the bearing pin, the cone having a plurality of cutting elements, the improvement comprising:

an elastomeric seal ring having an outer portion in sealing engagement with a seal surface on the cone and an inner portion;

an annular recess formed in the inner portion, defining an interior section on one lateral side of the recess and an exterior section on the other lateral side of the recess, the interior and the exterior sections of the inner portion being in dynamic sealing engagement with a seal surface on the bearing pin; and at least one excluder ring carried within the annular recess of the seal ring and having a face urged by the seal ring into sliding contact with the seal surface on the bearing pin, the excluder ring being of a material that differs from the seal ring, provides lubrication to the seal surface on the bearing pin, but not seal as well as the seal ring and has less wear resistance than the seal ring.

2. The bit according to claim 1, wherein the face of the excluder ring is substantially flush with the inner portion of the seal ring.

3. The bit according to claim 1, wherein said at least one excluder ring comprises a plurality of excluder rings.

4. The bit according to claim 1, wherein the face of the excluder ring contains a texture pattern.

5. An earth boring bit, comprising:

a body having a depending bearing pin;

a cone having a cylindrical cavity mounted rotatably on the bearing pin, the cone having an exterior containing a plurality of cutting elements, the cone and the bearing pin defining bearing spaces filled with a lubricant;

a seal ring of nitrile rubber, having an outer diameter in sealing contact with the cavity of the cone and an inner diameter, the seal ring having an exterior side exposed to drilling fluid during operation and an interior side exposed to lubricant within the bearing spaces; and at least one thermoplastic excluder ring embedded within the inner diameter of the seal ring, the excluder ring being located between the interior and exterior sides of the seal ring and having a face urged by the seal ring into dynamic contact with the bearing pin, the seal ring having sections located on opposite sides of the excluder ring that dynamically seal against the bearing pin; and wherein the excluder ring is formed of a material other than nitrile rubber that provides lubrication to the seal surface on the bearing pin, but does not seal as well as and has less wear resistance than the seal ring.

6. An earth boring bit, comprising:

a body having a depending bearing pin;

a cone having a cylindrical cavity mounted rotatably on the bearing pin, the cone having an exterior containing a plurality of cutting elements;

an annular groove in the cylindrical cavity of the cone;

a seal ring of elastomeric material and having an outer portion in sealing contact with the groove and an inner portion;

an annular recess in the inner portion;

an excluder ring in the annular recess and having a face urged by the seal ring into dynamic contact with the bearing pin, the inner portion of the seal ring having sections on opposite lateral sides of the excluder ring that dynamically seal against the bearing pin;

wherein the seal ring is formed of a nitrile rubber, and the excluder ring is formed of a material to add lubricant to the bearing pin and is polytetrafluoroethylene; and wherein the excluder ring does not seal against the bearing pin as well as the seal ring and has less wear resistance than the seal ring.

7. The bit according to claim 6, wherein the face of the excluder ring has a textured pattern.

* * * * *